US009074566B2

(12) United States Patent
Czimmek et al.

(10) Patent No.: US 9,074,566 B2
(45) Date of Patent: Jul. 7, 2015

(54) VARIABLE SPRAY INJECTOR WITH NUCLEATE BOILING HEAT EXCHANGER

(75) Inventors: Perry Czimmek, Williamsburg, VA (US); Hamid Sayar, Newport News, VA (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 723 days.

(21) Appl. No.: 13/332,532

(22) Filed: Dec. 21, 2011

(65) Prior Publication Data

US 2012/0267448 A1 Oct. 25, 2012

Related U.S. Application Data

(60) Provisional application No. 61/478,404, filed on Apr. 22, 2011.

(51) Int. Cl.
*F02M 53/06* (2006.01)
*F02M 51/06* (2006.01)

(52) U.S. Cl.
CPC ..... *F02M 53/06* (2013.01)

(58) Field of Classification Search
CPC ..... F02M 51/061; F02M 51/0642; F02M 51/0653; F02M 51/0664; F02M 51/0671; F02M 53/02; F02M 53/04; F02M 53/06
See application file for complete search history.

(56) References Cited

U.S. PATENT DOCUMENTS

| | | | | |
|---|---|---|---|---|
| 6,109,543 | A * | 8/2000 | Bright et al. | 239/135 |
| 6,561,168 | B2 * | 5/2003 | Hokao et al. | 123/557 |
| 7,628,340 | B2 | 12/2009 | Czimmek | |
| 7,677,468 | B2 | 3/2010 | Hornby et al. | |
| 2006/0075775 | A1 * | 4/2006 | Boiarski et al. | 62/612 |
| 2007/0221747 | A1 | 9/2007 | Hornby et al. | |
| 2007/0221761 | A1 | 9/2007 | Hornby et al. | |
| 2007/0221874 | A1 | 9/2007 | Hornby et al. | |
| 2007/0235086 | A1 | 10/2007 | Hornby et al. | |
| 2007/0235557 | A1 * | 10/2007 | Hornby et al. | 239/135 |
| 2007/0235569 | A1 | 10/2007 | Hornby et al. | |
| 2008/0223346 | A1 * | 9/2008 | Hornby | 123/549 |
| 2009/0294552 | A1 * | 12/2009 | Trapasso et al. | 239/132 |
| 2010/0034921 | A1 * | 2/2010 | Bolz et al. | 425/549 |
| 2010/0133363 | A1 * | 6/2010 | Imoehl | 239/585.1 |

FOREIGN PATENT DOCUMENTS

| | | | |
|---|---|---|---|
| DE | 102006058881 | A1 | 6/2008 |
| JP | 4072462 | A | 3/1992 |
| JP | 11037014 | A | 2/1999 |
| WO | 02/46600 | A1 | 6/2002 |

OTHER PUBLICATIONS

International Search Report and Written Opinion dated Jun. 18, 2012, from corresponding International Patent Application No. PCT/US2012/028002.

* cited by examiner

*Primary Examiner* — Darren W Gorman

(57) ABSTRACT

A heat exchanger, internal to an injector for a variable spray fuel injection system, uses nucleate boiling to maximize the heat flux from the heated metal to the fuel, wherein the nucleate boiling occurs along a control surface characterized by features conducive to generating detaching bubbles to transfer heat energy in a vapor flux. The source of heat flux may be an induction heater coil magnetically coupled to an appropriate loss component so that fuel inside a fuel component is heated to a desired temperature.

10 Claims, 5 Drawing Sheets

VARIABLE SPRAY INJECTOR WITH NUCLEATE BOILING HEAT EXCHANGER

CROSS-REFERENCE TO RELATED APPLICATIONS

This application is a non-provisional of, and claims priority to the Apr. 22, 2011, filing date of, U.S. provisional patent application Ser. No. 61/478,404, entitled Variable Spray Injector with Nucleate Boiling Heat Exchanger, the entire content of which is incorporated herein by reference.

And this application is related to the following U.S. non-provisional patent applications filed on the same day as this application:

Synchronous Full-Bridge Power Oscillator with Leg Inductors, invented by Perry Czimmek, and identified by Ser. No. 13/332,501;

Synchronous Full-Bridge Power Oscillator, invented by Perry Czimmek, and identified by Ser. No. 13/332,506;

Synchronized Array Bridge Power Oscillator, invented by Perry Czimmek and Mike Hornby, and identified by Ser. No. 13/332,517;

Synchronized Array Power Oscillator with Leg Inductors, invented by Perry Czimmek and Mike Hornby, and identified by Ser. No. 13/332,521; and Adaptive Current Limit Oscillator Starter, invented by Perry Czimmek, and identified by Ser. No. 13/332,539.

BACKGROUND

Embodiments of the invention relate generally to heated tip fuel injectors, and more particularly, to heat transfer in an induction-heated fuel injector.

There is a continued need for improving the emissions quality of internal combustion engines. At the same time, there is pressure to minimize engine crank times and time from key-on to drive-away, while maintaining maximum fuel economy. Those pressures apply to engines fueled with alternative fuels such as ethanol as well as to those fueled with gasoline.

During cold temperature engine start, the conventional spark ignition internal combustion engine is characterized by high hydrocarbon emissions and poor fuel ignition and combustibility. Unless the engine is already at a high temperature after stop and hot-soak, the crank time may be excessive, or the engine may not start at all. At higher speeds and loads, the operating temperature increases and fuel atomization and mixing improve.

During an actual engine cold start, the enrichment necessary to accomplish the start leaves an off-stoichiometric fueling that materializes as high tail-pipe hydrocarbon emissions. The worst emissions are during the first few minutes of engine operation, after which the catalyst and engine approach operating temperature. Regarding ethanol fueled vehicles, as the ethanol percentage fraction of the fuel increases to 100%, the ability to cold start becomes increasingly diminished, leading some manufacturers to include a dual fuel system in which engine start is fueled with conventional gasoline and engine running is fueled with the ethanol grade. Such systems are expensive and redundant.

Another solution to cold start emissions and starting difficulty at low temperature is to pre-heat the fuel to a temperature where the fuel vaporizes quickly, or vaporizes immediately ("flash boils"), when released to manifold or atmospheric pressure. Pre-heating the fuel replicates a hot engine as far as fuel state is considered.

A number of pre-heating methods have been proposed, most of which involve preheating in a fuel injector. Fuel injectors are widely used for metering fuel into the intake manifold or cylinders of automotive engines. Fuel injectors typically comprise a housing containing a volume of pressurized fuel, a fuel inlet portion, a nozzle portion containing a needle valve, and an electromechanical actuator such as an electromagnetic solenoid, a piezoelectric actuator or another mechanism for actuating the needle valve. When the needle valve is actuated, the pressurized fuel sprays out through an orifice in the valve seat and into the engine.

One technique that has been used in preheating fuel is to inductively heat metallic elements comprising the fuel injector with a time-varying magnetic field. Exemplary fuel injectors having induction heating are disclosed in U.S. Pat. No. 7,677,468, U.S. patent application Ser. Nos.: 20070235569, 20070235086, 20070221874, 20070221761 and 20070221747, the contents of which are hereby incorporated by reference herein in their entirety. The energy is converted to heat inside a component suitable in geometry and material to be heated by the hysteretic and eddy-current losses that are induced by the time-varying magnetic field.

The inductive fuel heater is useful not only in solving the above-described problems associated with gasoline systems, but is also useful in pre-heating ethanol grade fuels to accomplish successful starting without a redundant gasoline fuel system.

Once a useful heating method is available, the next challenge is transferring the heat from the appropriate loss component to the fuel to be heated. Conventional methods include convection and conduction heat transfer from the selectively heated metal components to the fuel. These conventional methods suffer from a limit imposed by the thermal conductivity and surface area of the materials involved. If one attempts to increase the heat flux into a given volume of fluid simply by increasing the temperature of the selectively heated components, the result is often exceeding the vapor pressure of the fuel for that new higher temperature and the generation of a wall film of vaporized fuel, the film boiling regime, that then reduces thermal conductivity because it is less efficient to transfer heat into a gas than to transfer heat into a liquid.

Embodiments of the invention provide improved heat transfer, overcome difficulties associated with alternative solutions, and avoid the generation of film boiling.

BRIEF SUMMARY

Embodiments of the invention improve the heat transfer of a variable spray injector beyond free-convection and conduction heat transfer heat exchanger methods. In accordance with one or more embodiments of the invention, a selectively heated component may have a surface that maximizes heat transfer through nucleate boiling.

Numerous experimental investigations have sought to optimize heat transfer through convection in which turbulence, mixing, and fluid motion are enhanced, as well as conduction where surface area is maximized and resident time of the fluid on that surface is maximized. At the same time that convection and conduction are maximized, the generation of phase-change in the form of boiling was to be carefully avoided to prevent significant metered mass rate shift in flow due to gas fraction and the decrease in thermal conduction with film boiling creating insulating surfaces of vapor.

In accordance with embodiments of the invention, boiling is not avoided. Instead, boiling is enhanced, encouraged, and limited to nucleate boiling thereby advantageously expediting heat transfer. Additionally, nucleate boiling may be encouraged even below the vapor pressure of the fluid in what is called subcooled nucleate boiling. One or more embodiments of the invention deliberately create temperature gradients and nucleation sites for favorable generation of vapor bubbles such that generation and detachment of a relatively large quantity of relatively small vapor bubbles creates a phase change heat flux that is greater than that of the normal free-convection and conduction heat flux.

DETAILED DESCRIPTION

Figure 1:
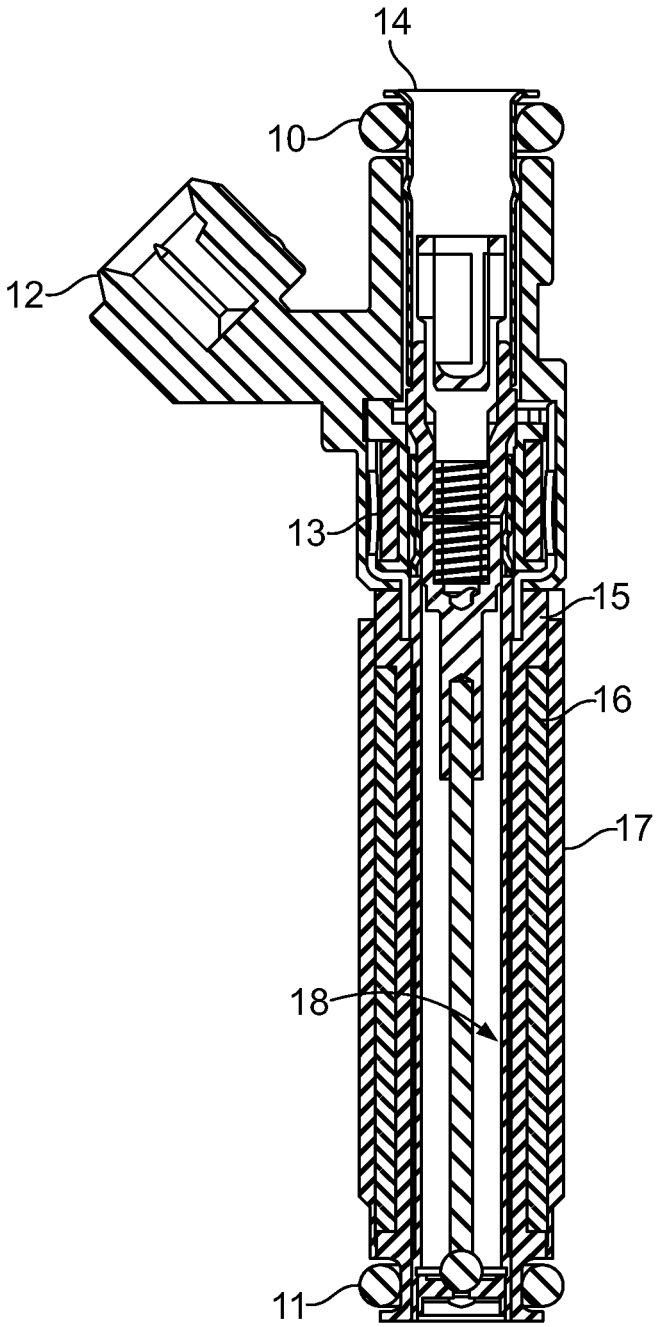
FIG. 1 is a drawing depicting an example inductively heated variable spray fuel injector.

Embodiments of the invention are described herein as implemented in a variable spray fuel injector with an induction heated loss component. Referring to FIG. 1, which is an inductively heated variable spray fuel injector, the basic configuration includes a sealing method to the source of fuel supply, O-ring 10, between the supply and the fuel inlet tube 14 structure. The electrical connector 12 provides a means of conducting power to solenoid valve coil 13 and inductive heater coil 16. The appropriate loss component, whose surface 18 will provide the control surface for nucleated boiling heat transfer, is surrounded by bobbin 15 but is separated by a thermal barrier or insulator from the loss component. A heater coil 16 is placed upon the bobbin and is confined between the bobbin and a housing or shell 17. The intake manifold of the internal combustion engine is sealed to the injector with a sealing method, such as an O-ring 11.

Figure 2A:
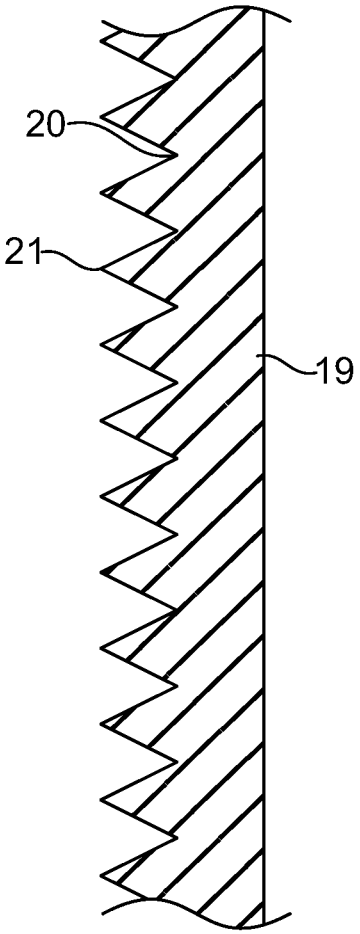
FIGS. 2*a* and 2*b* depict example nucleating heater surfaces in accordance with embodiments of the invention.

With reference to FIG. 2*a*, an appropriate loss component 19 in FIG. 2*a* has a control surface, which includes a texture appropriate to effect nucleated boiling. In FIG. 2*a* that texture is formed by a triangular shape that is repeated to maximize nucleation sites and that has an amplitude that spans the trough 20 to the peak 21. This texture may be formed by any suitable type of shape, including, but not limited to, square, curved, or random or any other texture that varies the thickness of the loss component 19. The variation in thickness allows for a temperature gradient to occur such that nucleation is encouraged to occur closer toward the trough 20 and that the vapor bubble formed from nucleated boiling will be size limited by some relation to the depth of the trough. Additionally, an inductive heating method with an appropriate loss component enhances the gradient from peak 21 to trough 20 through the electromagnetic skin-effect.

Figure 2B:
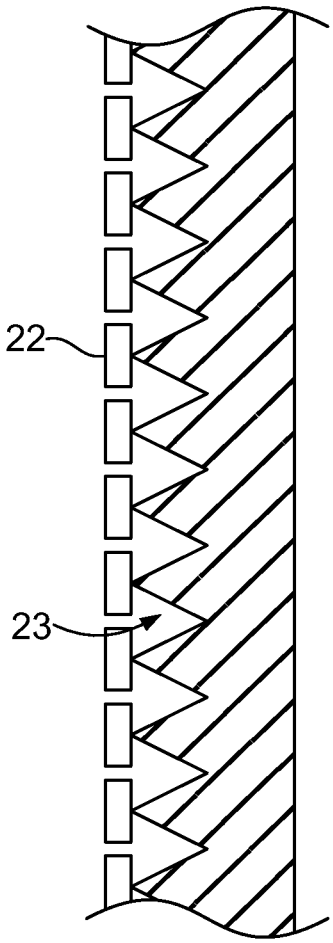
Figure 3A:
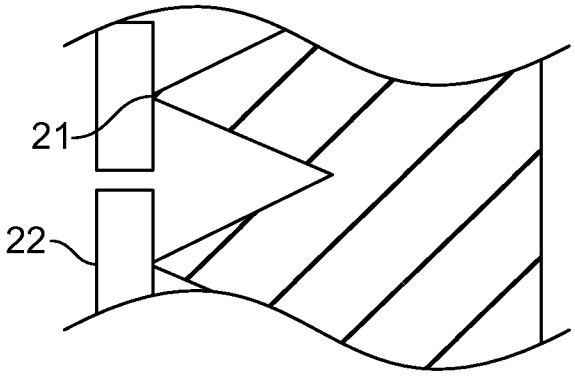
FIGS. 3*a*-3*c* depict principle nucleated boiling in accordance with embodiments of the invention.
Figure 3B:
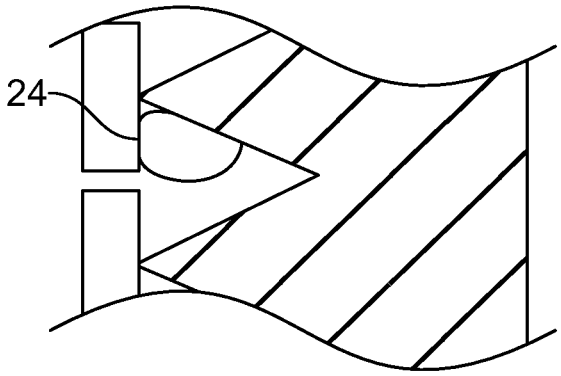
Figure 3C:
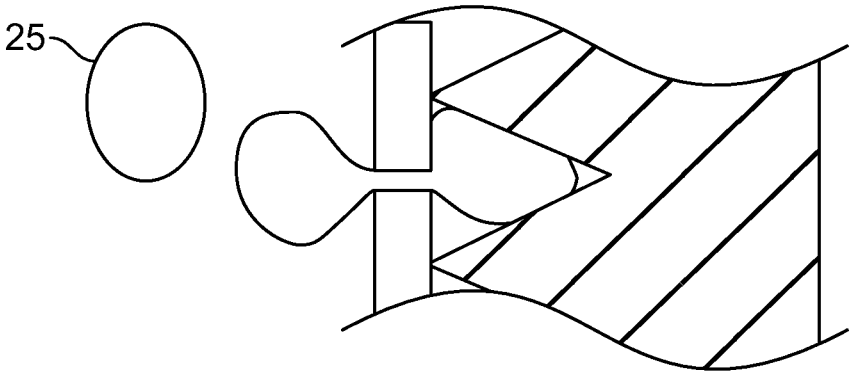

In another embodiment, with reference to FIG. 2*b*, the texture is enhanced by a foil or screen shield 22 that creates a cavity 23 that has a fluidic and gaseous connection to the fuel volume desired to be heated. The cavity allows for a larger temperature gradient to exist as compared to the unshielded embodiment shown in FIG. 2*a*. Nucleated boiling heat transfer in accordance with embodiments of the invention is described with reference to FIGS. 3*a*-3*c*, which include enlarged views of the cavity 23 of the embodiment depicted in FIG. 2*b*. FIG. 3*a* shows the cavity 23 bounded by the peak 21 and the shield 22. FIG. 3*b* shows a nucleated bubble 24, attaching itself to the top due to buoyancy forces.

As the nucleated bubble 24 grows, it is absorbing energy in the form of latent heat of vaporization from the selectively heated component 19. The nucleated bubble 24, being volume constrained, expands through the fluidic and gaseous conduit across the shield 22, and ultimately surface-tension effects pinch off the nucleated bubble 24 such that an isolated bubble 25 forms and carries the energy stored in the vapor away from the cavity 23 and into cooler fluid, where the heat is released and the bubble re-condenses to liquid having transferred the energy to the liquid by a means with a greater heat flux than convection or conduction alone.

Figure 4:
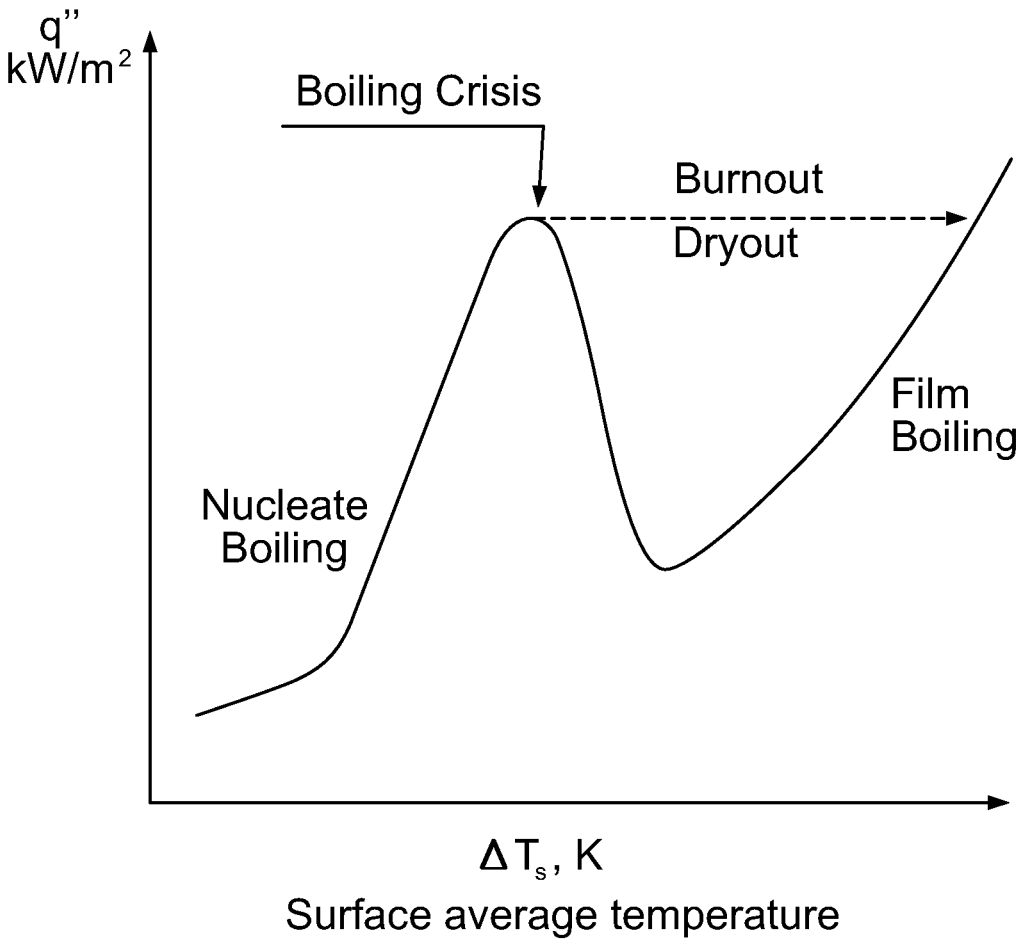
FIG. 4 is a graphic depicting simplified version of the principle boiling regimes, based on the Nukiyama Boiling Curve, circa. 1934.
Figure 5:
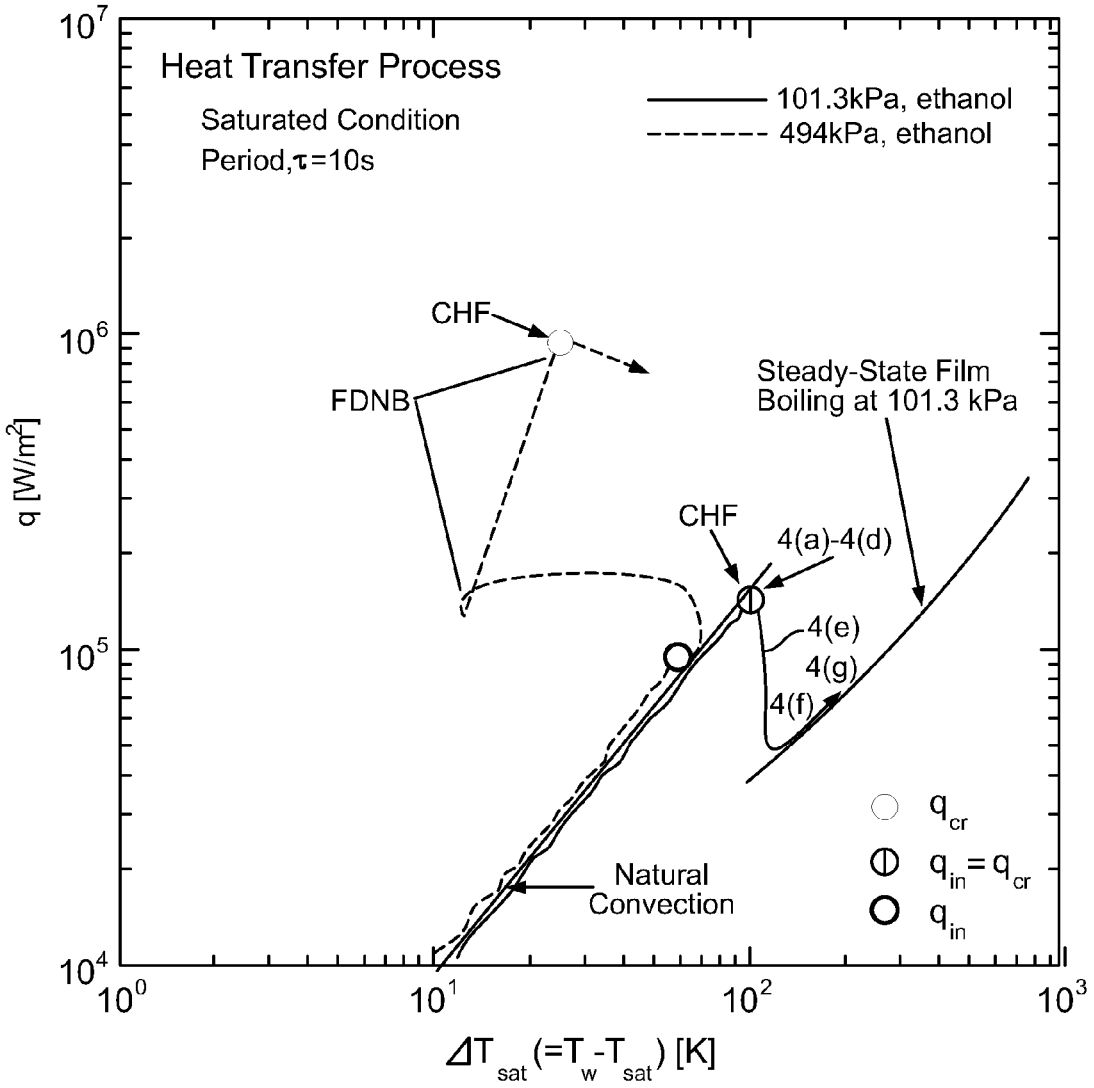
FIG. 5 is a graphic of the ethanol principle boiling regimes at two pressures, based on measured data by Park, Fukuda, and Liu; "About Pool Boiling CHF in Different Wettability Liquids", Japan 2007.

FIG. 4 shows the heat flux at different heat transfer regimes, with FIG. 5 going into more detail such that the advantage of nucleated boiling is shown, particularly for a variable spray injector metering ethanol, or what would be called E100 in terms of fuel designation. Referring to FIG. 5, the natural convection slope has the lowest Watts per square meter heat transfer, and the Fully Developed Nucleated Boiling, or FDNB on the graph, has the highest Watts per square meter heat transfer. Also note that FIG. 5 shows the FDNB regime being attained at 494 kPa, a pressure that is above 101.3 kPa, which may also be referred to as ambient atmospheric pressure. This is advantageous in situations in which the variable spray injector operates at a metering pressure where FDNB is possible. Nucleate boiling heat transfer is viable up to the Critical Heat Flux, or CHF, where film boiling is approached, such that there is an operating area that may be optimized for a nucleate boiling heat exchanger regarding pressure and temperature.

The foregoing detailed description is to be understood as being in every respect illustrative and exemplary, but not restrictive, and the scope of the invention disclosed herein is not to be determined from the description of the invention, but rather from the claims as interpreted according to the full breadth permitted by the patent laws. For example, while the nucleate boiling heat exchanger of the invention is described herein for a variable spray injector utilizing an induction heater coil for the heater in an internal combustion engine fuel injector, embodiments of the invention may be used to improve heat exchangers of variable spray injectors that use other methods such as resistive heat or positive-temperature-coefficient ("PTC") heaters. It is to be understood that the embodiments shown and described herein are merely illustrative of the principles of the invention and that various modifications may be implemented by those skilled in the art without departing from the scope and spirit of the invention.

The invention claimed is:

1. A variable spray injector with a heat exchanger comprising:

a loss component;

a texture surface configured to facilitate nucleate boiling heat transfer; and a member adjacent to portions of the textured surface to define plurality of cavities, the member having an opening associated with each cavity providing a fluidic and gaseous coupling between a fluid to be heated and the cavity.

2. The variable spray injector of claim 1, wherein the member and openings therein are defined by a perforated foil.

3. The variable spray injector of claim 1, wherein the member and openings therein are defined by a screen.

4. The variable spray injector of claim 1, wherein the member and openings therein are defined by a porous material.

5. The variable spray injector of claim 1, wherein the textured surface has a first topographic feature and a second topographic feature that are constructed and arranged so that a temperature gradient occurs from the first topographic feature to the second topographic feature.

6. The variable spray injector of claim 1, wherein a temperature of the loss component is maintained below a boiling crisis temperature for a fluid to be heated within the variable spray injector.

7. The variable spray injector of claim 1, wherein a temperature of the loss component is maintained above 80° C. and below 200° C. for heating ethanol fuels with compositions greater than 50% ethanol.

8. The variable spray injector of claim 1, wherein a fuel pressure supplied is greater than 3 Bar Absolute but less than 60 Bar Absolute for ethanol fuels with compositions greater than 50% ethanol.

9. The variable spray injector of claim 5, wherein the first topographic feature is a peak and the second topographic feature is an adjacent trough.

10. The variable spray injector of claim 1, wherein each opening is constructed and arranged to permit a nucleated bubble to escape from the associated cavity through the opening.

* * * * *